US007654702B1

(12) United States Patent
Ding et al.

(10) Patent No.: US 7,654,702 B1
(45) Date of Patent: Feb. 2, 2010

(54) LED LAMP

(75) Inventors: Jun Ding, Shenzhen (CN); Lin Yang, Shenzhen (CN); Ye-Fei Yu, Shenzhen (CN); Xin-Xiang Zha, Shenzhen (CN); Jer-Haur Kuo, Taipei Hsien (TW)

(73) Assignees: Fu Zhun Precision (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/247,206

(22) Filed: Oct. 7, 2008

(30) Foreign Application Priority Data

Aug. 25, 2008 (CN) ..... 2008 1 0304174

(51) Int. Cl.
*F21V 29/00* (2006.01)

(52) U.S. Cl. ..... 362/294; 362/218; 362/219; 362/373; 362/249.02

(58) Field of Classification Search ..... 362/97.1, 362/97.3, 219, 225, 218, 217.05, 249.02, 362/249.06, 249.14, 294, 345, 373
See application file for complete search history.

(56) References Cited

U.S. PATENT DOCUMENTS

| | | | | |
|---|---|---|---|---|
| 6,871,993 | B2 * | 3/2005 | Hecht | 362/555 |
| 7,001,047 | B2 * | 2/2006 | Holder et al. | 362/249.04 |
| 7,111,971 | B2 * | 9/2006 | Coushaine et al. | 362/545 |
| 7,281,823 | B2 * | 10/2007 | Moisel | 362/294 |
| 2009/0097265 | A1 * | 4/2009 | Sun et al. | 362/373 |

* cited by examiner

*Primary Examiner*—Thomas M Sember
(74) *Attorney, Agent, or Firm*—Frank R. Niranjan

(57) ABSTRACT

An LED lamp (100) includes a lamp enclosure (10), a heat sink (51) and two LED modules (30). The lamp enclosure has a recess (15) and an opening (156). The heat sink is received in the recess of the lamp enclosure. The LED modules are attached to a bottom of the heat sink and oriented downwardly and outwardly towards an internal surface (1110) of the lamp enclosure. Light emitted by the LED module is firstly directed to the internal surface and other internal surfaces (130, 1130), and then reflected from the internal surfaces to an outside of the LED lamp through the opening.

9 Claims, 5 Drawing Sheets

LED LAMP

BACKGROUND

1. Field of the Invention

The present invention relates to a light emitting diode (LED) lamp, and more particularly to an LED lamp which can provide an even and soft light.

2. Description of Related Art

As an energy-efficient light, an LED lamp has a trend of substituting for the fluorescent lamp for a lighting purpose. In order to increase the overall lighting brightness, a plurality of LEDs are often incorporated into a lamp. It is well known that the LEDs are arranged in a form of point light sources in the lamp. Thus, discomfort glare is caused by the LED light sources. Even worse, the highly focused and intensive light sources of the LEDs may cause damages to a viewer's eyes when he (she) directly gazes at the LEDs.

What is needed, therefore, is an LED lamp which can overcome the above mentioned disadvantages.

SUMMARY

An LED lamp according to an exemplary embodiment includes a lamp enclosure, a heat sink and two LED modules. The lamp enclosure has a recess and an opening above and in communication with the recess. The heat sink is received in the recess of the lamp enclosure. The LED modules are attached to a bottom of the heat sink and oriented downwardly and outwardly towards two opposite lateral portions of a bottom plate of the lamp enclosure. Light emitted by the LED module is firstly directed to an internal surface of the lamp enclosure, and then reflected from the internal surface to an outside of the LED lamp through the opening.

Other advantages and novel features of the present invention will become more apparent from the following detailed description when taken in conjunction with the accompanying drawings.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
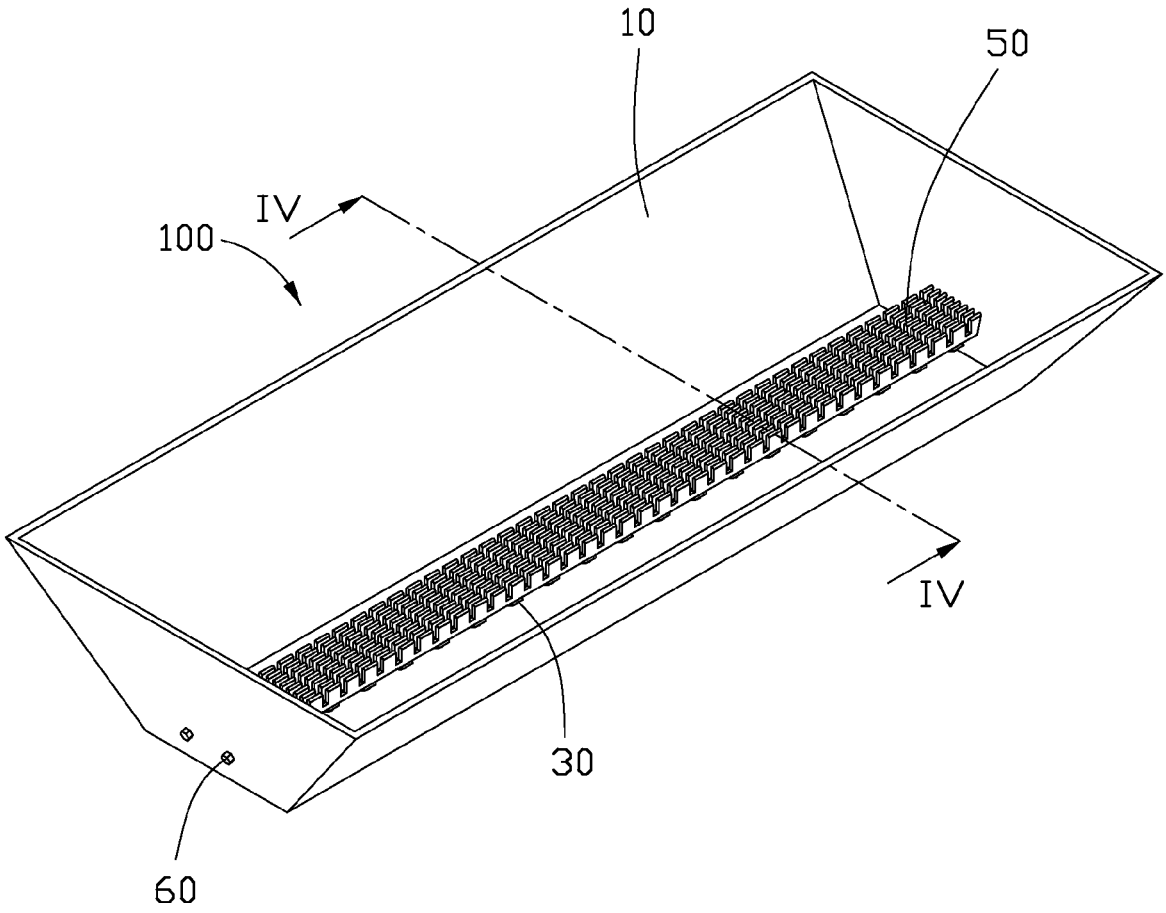
FIG. 1 is an assembled, isometric view of an LED lamp in accordance with a first embodiment of the present invention.

Referring to FIG. 1, an LED lamp 100 in accordance with a first embodiment of the present invention is shown. The LED lamp 100 comprises a lamp enclosure 10, two LED modules 30 and a heat dissipation module 50. The lamp enclosure 10 has a concave configuration. The heat dissipation module 50 is secured to the lamp enclosure 10 via four screws 60. The LED modules 30 are respectively attached to two bottom surfaces 511 of the heat dissipation module 50 and keep a distance from a bottom plate 111 of the lamp enclosure 10.

Figure 2:
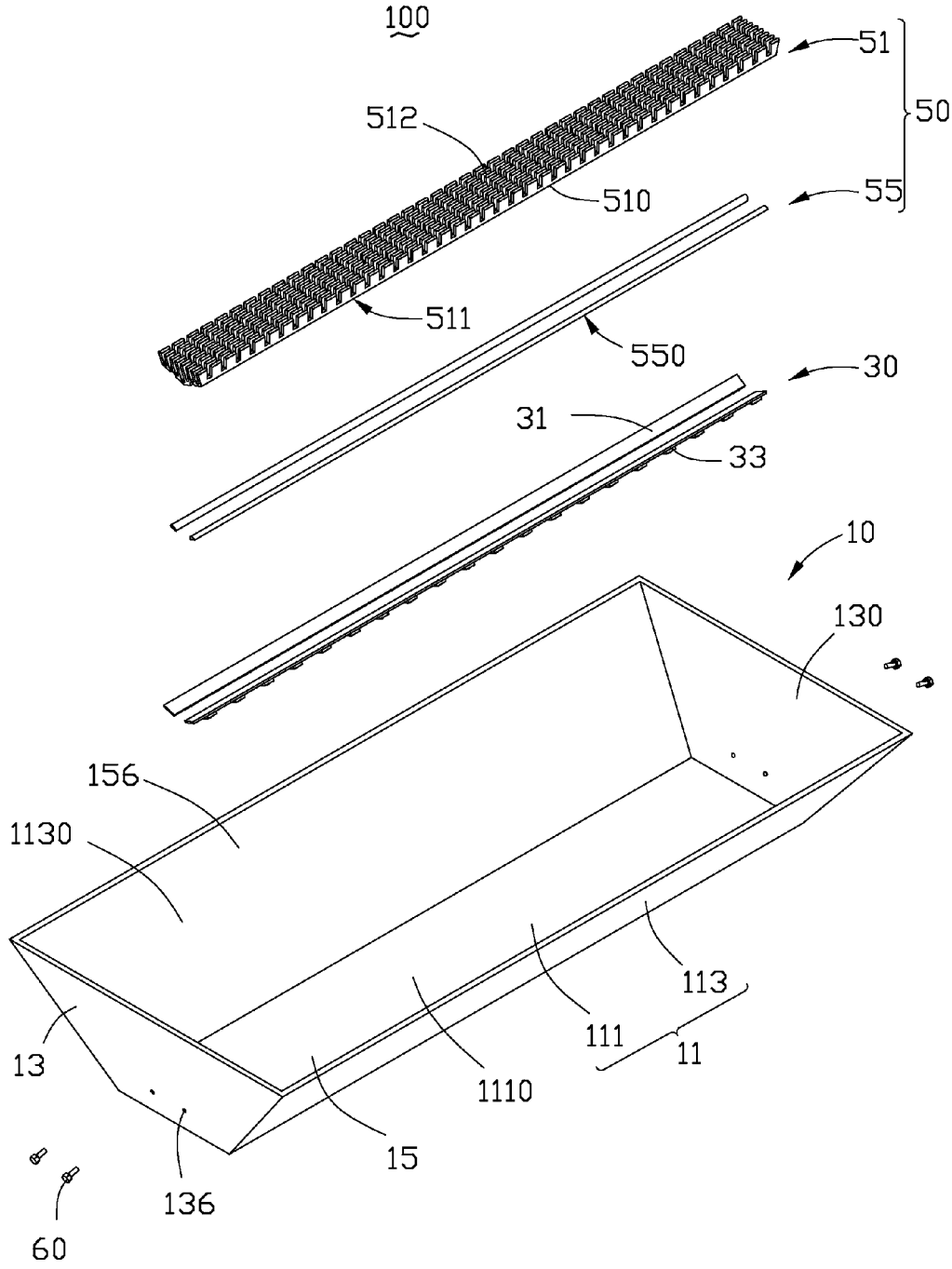
FIG. 2 is an exploded, isometric view of the LED lamp shown in FIG. 1.
Figure 3:
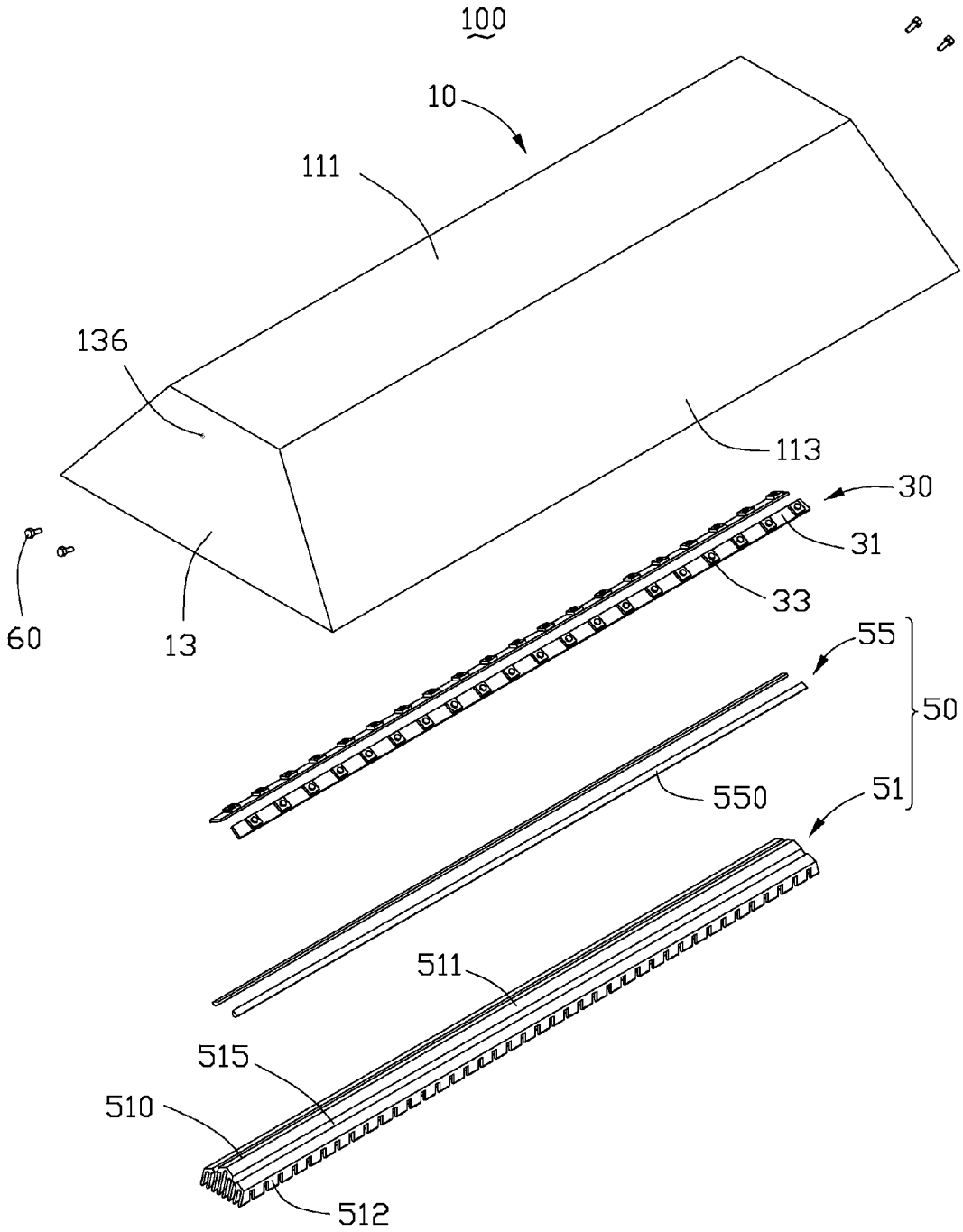
FIG. 3 is a view similar to FIG. 2, but viewed from a different aspect.

Referring to FIGS. 2-3, the lamp enclosure 10 includes a concave housing 11 and two side walls 13 integrally formed at two longitudinal ends of the housing 11 respectively. The housing 11 and the side walls 13 cooperatively form a recess 15 in the lamp enclosure 10. The lamp enclosure 10 defines an opening 156 at a top side thereof. The opening 156 is located above and communicates with the recess 15. The housing 11 has an elongated configuration, which has a cross section like that of a trough. The housing 11 includes the bottom plate 111 and two lateral plates 113. The bottom plate 111 is an elongated, rectangular, flat plate and is configured to form a bottom side of the housing 11. The lateral plates 113 are elongated and extend integrally from two opposite sides of the bottom plate 111, respectively. The lateral plates 113 extend slantingly from the bottom plate 111 to the opening 156. The bottom plate 111 has an internal surface 1110. The lateral plates 113 each have an internal surface 1130.

The side walls 13 are trapeziform, flat plates. The side walls 13 are integrally connected to longitudinal ends of the bottom plate 111 and the lateral plates 113. The side walls 13 each have an internal surface 130. The internal surfaces 130, 1110, 1130 are located inside the lamp enclosure 10 and face the recess 15. The recess 15 becomes wider and wider from bottom to top of the lamp enclosure 10. The side walls 13 each define two through holes 136 for engagingly receiving the screws 60. A high reflective material, for example, nickel or aluminum, is painted on the internal surfaces 1110, 1130, 130.

The LED modules 30 each include an elongated substrate 31 having a rectangular shape, and a plurality of LEDs 33 equidistantly mounted on the substrate 31. Preferably, the substrate 31 is a printed circuit board. Alternatively, the substrate 31 is made of a metallic plate and has a layer of circuit, for example, a flexible printed circuit attached thereon. The LEDs 33 are electrically mounted on the flexible printed circuit. The substrate 31 has an elongated configuration, extends in the lamp enclosure 10 along a lengthwise direction thereof, and is slantwise to the bottom plate 111 (better seen in FIG. 4).

The heat dissipation module 50 includes a heat sink 51 and two heat pipes 55. The heat sink 51 includes a base 510 and a plurality of fins 512. The base 510 has an elongated configuration with a V-shaped cross section. The two bottom surfaces 511 are located at two lateral sides of a bottom of the base 510. The fins 512 extend upwardly from a top of the base 510. Two elongated grooves 515 are respectively defined in the bottom surfaces 511 of the base 510 of the heat sink 51 of the heat dissipation module 50 for receiving the heat pipes 55.

Each of the heat pipes 55 has a flat outer surface 550. In assembly, the heat pipes 55 are received in the grooves 515 of the base 510 and secured to the heat sink 51 via soldering or adhering. The flat outer surface 550 of each heat pipe 55 is coplanar with the corresponding bottom surface 511 of the base 510 of the heat sink 51 of the heat dissipation module 50. The LED modules 30 are respectively attached to the bottom surfaces 511 via soldering or adhering and located at positions corresponding to the heat pipes 55 so that the substrates 31 each cover the corresponding flat outer surface 550 of the heat pipe 55. A thermal interface material can be applied between the heat pipes 55 and the substrates 31 so as to reduce heat transfer resistance therebetween. Accordingly, heat generated by the LEDs 33 can be quickly transmitted to the heat pipes 55 via the substrates 31.

Figure 4:
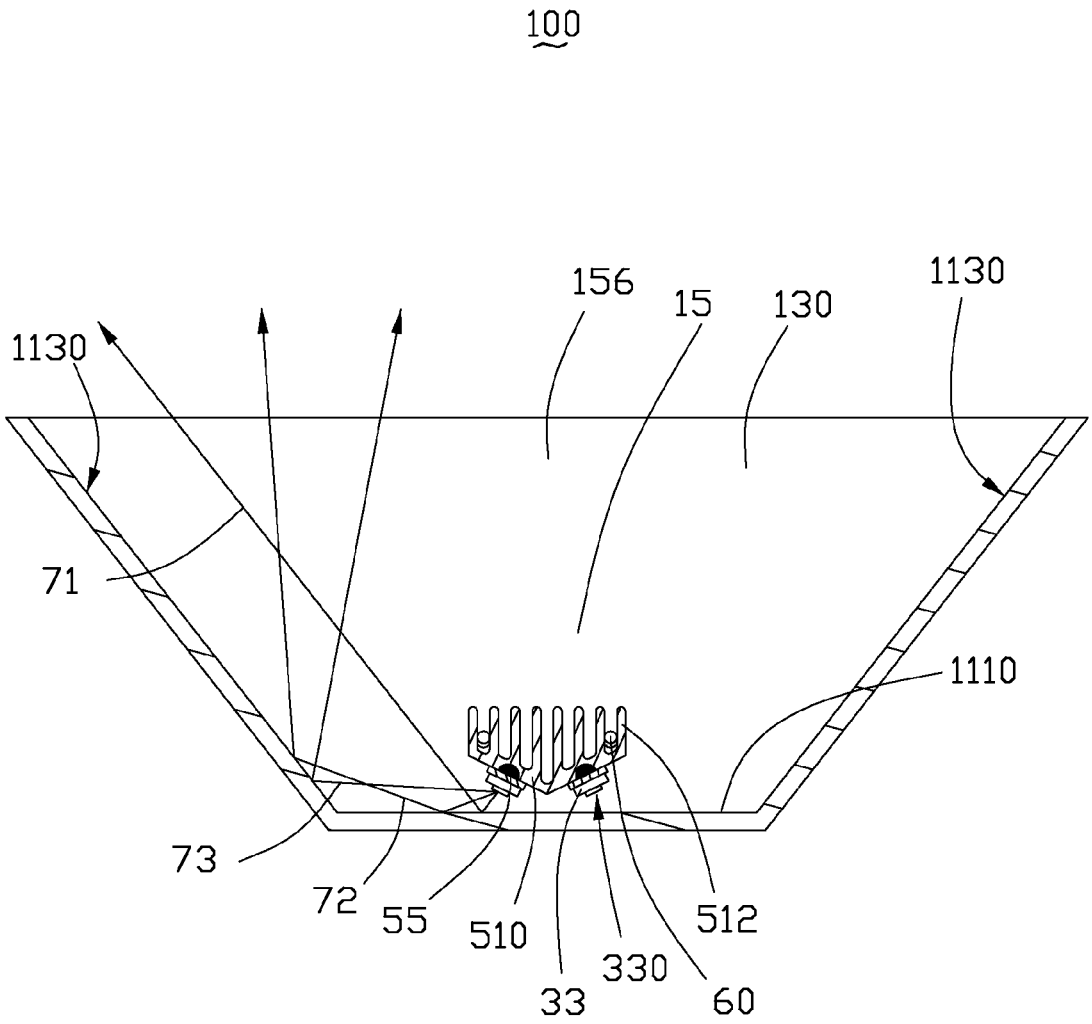
FIG. 4 is a cross-sectional view of the LED lamp shown in FIG. 1, taken along a line IV-IV thereof.

Also referring to FIG. 4, the screws 60 extend through the through holes 136 to screw into the fins 512 of the heat sink 51 so that the heat sink 51 is secured to the lamp enclosure 10. Thus, the heat dissipation module 50 and the LED modules 30 are located in a middle of the recess 15, and adjacent to the bottom plate 111 of the housing 11 with a small distance therebetween. The LEDs 33 are downwardly and outwardly oriented towards the bottom plate 111.

Each of the LED 33 has a light emitting surface 330. The light emitting surface 330 is oriented downwardly and outwardly towards the internal surface 1110 so that light emitted by the LEDs 33 is firstly directed towards the internal surfaces 1110, 1130, 130 of the lamp enclosure 10. For example, a portion of light 71 generated by the light emitting surface 330 is firstly directed to the internal surface 1110, and then reflected from the internal surface 1110 to an outside of the LED lamp 100 through the opening 156. Another portion of light 72 is firstly directed to the internal surface 1110, then reflected from the internal surface 1110 to the internal surface 1130 of the lateral plates 113, and at last reflected from the internal surface 1130 to the outside of the LED lamp 100 through the opening 156. Another portion of light 73 is firstly directed to a lower portion of the internal surface 1130 of the lateral plate 113, and then reflected from the internal surface 1130 to the outside of the LED lamp 100 through the opening 156.

In the illustrated embodiment, the LED lamp 100 is constructed in such a manner that the LEDs 33 do not directly emit their light to the outside of the lamp 100 through the opening 156. Thus, a user of the LED lamp 100 will not directly gaze at the LEDs 33 and discomfort glare and damages to the user's eyes are accordingly avoided. The LED lamp 100 can provide the user with a soft and even light source.

Heat generated by the LEDs 33 can be quickly absorbed by the heat pipes 55 and dissipated to ambient air via the heat sink 51. Thus, the LED modules 30 can be prevented from becoming overheated and have a high work efficiency and a long service life.

Figure 5:
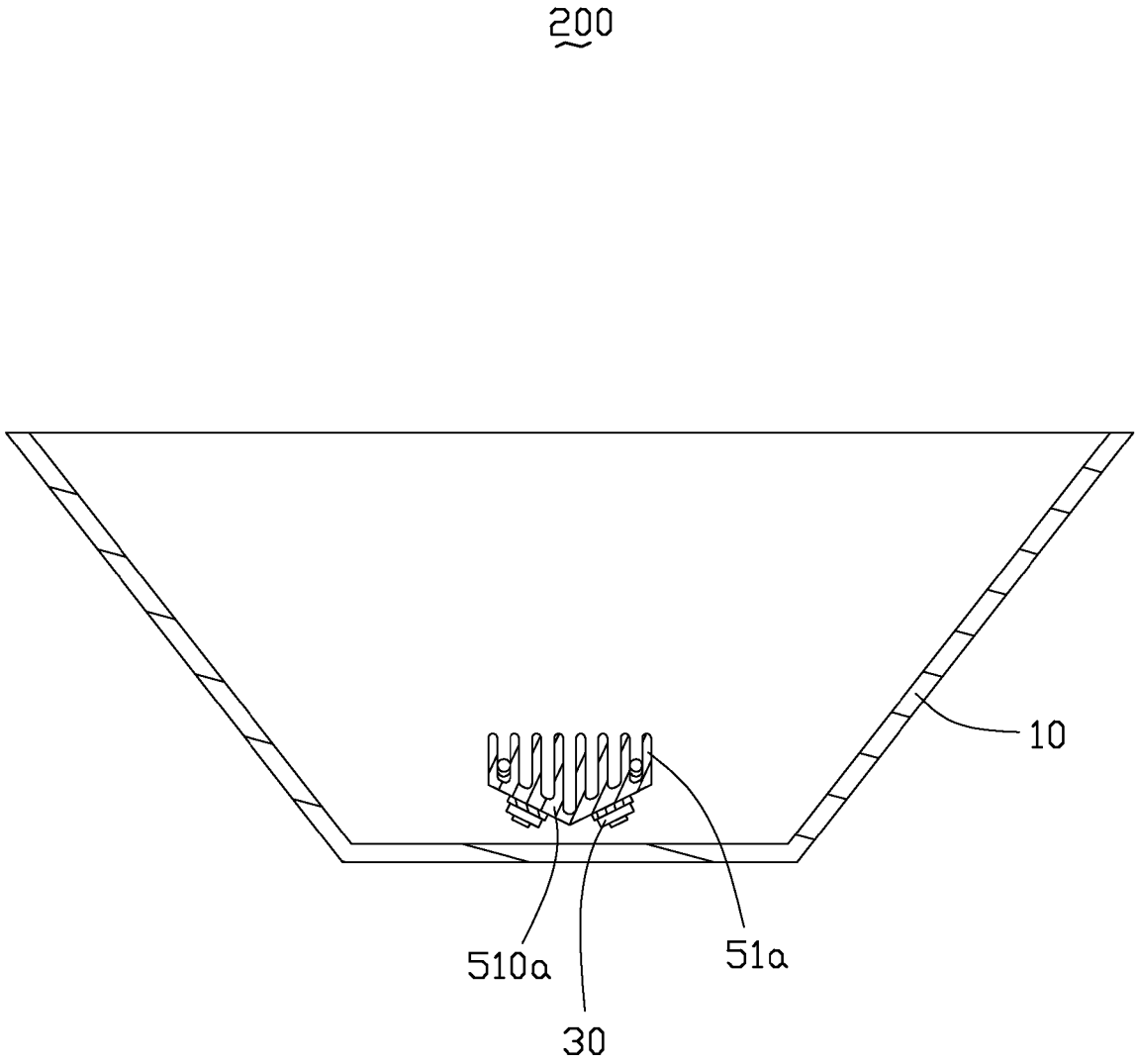
FIG. 5 is a cross-sectional view of an LED lamp in accordance with a second embodiment of the present invention.

Referring to FIG. 5, an LED lamp 200 in accordance with a second embodiment of the present invention is shown. The LED lamp 200 has a similar configuration to the LED lamp 100. The LED lamp 200 differs from LED lamp 100 only in that the LED modules 30 are directly attached to the base 510*a* of the heat sink 51*a* without heat pipes being incorporated between the LED modules 30 and the base 510*a*.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED lamp comprising:

a lamp enclosure defining therein a recess and an opening, the opening being located above and communicating with the recess;

a heat sink being received in the recess of the lamp enclosure;

at least one LED module being attached to a bottom portion of the heat sink and oriented downwardly and outwardly towards a bottom plate of the lamp enclosure, light emitted by the LED module being firstly directed to an internal surface of the lamp enclosure, and then reflected from the internal surface to an outside of the LED lamp through the opening; and at least one heat pipe;

wherein the heat sink includes a base and a plurality of fins, the fins extending upwardly from a top of the base, and the at least one LED module is attached to a bottom of the base;

wherein the at least one heat pipe is located between the base of the heat sink and at least one LED module; and wherein the base of the heat sink has a V-shaped cross section, the at least one LED module includes two LED modules, and the LED modules are respectively attached to two bottom surfaces of the base.

2. The LED lamp as claimed in claim 1, wherein the at least one heat pipe includes two heat pipes, the heat pipes each have a flat outer surface, each of the heat pipes is received in a groove defined in the base, and the flat outer surface of each of the heat pipes is coplanar with a corresponding bottom surface of the base.

3. The LED lamp as claimed in claim 1, wherein the LED modules each include a substrate and a plurality of LEDs mounted on the substrate, the substrate is attached to a corresponding bottom surface of the base.

4. The LED lamp as claimed in claim 1, wherein the lamp enclosure includes an elongated, concave housing and two side walls formed at two longitudinal ends of the housing respectively, the housing and the side walls cooperatively form the recess in the lamp enclosure.

5. The LED lamp as claimed in claim 4, wherein the housing has a cross section similar to that of a trough, and the recess becomes wider and wider from bottom to top of the lamp enclosure.

6. The LED lamp as claimed in claim 4, wherein at least two through holes are defined in each of the side walls, screws extend through the at least two through holes to screw into the fins so that the heat sink is secured to the lamp enclosure and spaces a distance from the bottom plate of the lamp enclosure.

7. An LED lamp comprising:

a lamp enclosure defining therein a recess and an opening, the opening being located above and communicating with the recess;

a heat sink being received in the recess of the lamp enclosure, the heat sink including a base having a V-shaped cross section, a plurality of fins extending from a top of the base; and two arrays of LEDs respectively attached to two lateral sides of a bottom of the base and oriented towards an internal surface of the lamp enclosure, light emitted by the two arrays of LEDs being firstly directed to the internal surface of the lamp enclosure, and then reflected from the internal surface to an outside of the LED lamp through the opening.

8. The LED lamp as claimed in claim 7, further comprising two heat pipes, the heat pipes being located between the base of the heat sink and the two arrays of LEDs.

9. An LED lamp comprising:

a lamp enclosure defining therein a recess and an opening, the opening being located above and communicating with the recess;

a heat dissipation module being received in the recess of the lamp enclosure and located adjacent to a bottom of the lamp enclosure; and a plurality of LEDs being mounted on the heat dissipation module and oriented towards the bottom of the lamp enclosure, light emitted by the LEDs being firstly directed to an internal surface of the lamp enclosure, and then reflected from the internal surface to an outside of the LED lamp through the opening;

wherein the heat dissipation module includes a base having a V-shaped cross section whereby a bottom surface of the base is divided into two portions, a plurality of fins extending from the base, and two heat pipes being embedded in the two portions of the bottom surface of the base, the LEDs being mounted on the two portions of the bottom surface of the base and thermally connecting with the two heat pipes.

* * * * *